United States Patent [19]

Zimmer

[11] 4,056,055

[45] Nov. 1, 1977

[54] ROTARY SCREEN SUPPORTING AND TENSIONING MEANS

[76] Inventor: Johannes Zimmer, Ebentalerstrasse 133, A-9020 Klagenfurt, Austria

[21] Appl. No.: 645,230

[22] Filed: Dec. 29, 1975

[30] Foreign Application Priority Data

Dec. 30, 1974 Austria ..... 10368/74
Oct. 2, 1975 Austria ..... 7555/75

[51] Int. Cl.[2] ..... B41F 15/38
[52] U.S. Cl. ..... 101/128.1
[58] Field of Search ..... 101/116, 127.1, 128.1; 118/213, 301, 406; 209/403, 405, 410, 411, 406; 308/20

[56] References Cited

U.S. PATENT DOCUMENTS

| | | | |
|---|---|---|---|
| 784,229 | 3/1905 | Rose | 209/406 |
| 3,183,831 | 5/1965 | Zimmer | 101/116 X |
| 3,556,004 | 1/1971 | Mitter et al. | 101/116 |
| 3,565,002 | 2/1971 | Boehm | 101/116 |
| 3,892,176 | 7/1975 | Van der Winden | 101/127.1 X |

*Primary Examiner*—Edgar S. Burr
*Assistant Examiner*—R. E. Suter
*Attorney, Agent, or Firm*—Haseltine, Lake & Waters

[57] ABSTRACT

A rotary printing machine in which a cylindrical stencil is connected to an end ring at each end. At least one frame carries a supporting body on which rollers are rotatably mounted. The rollers engage one or more of the end rings on circular surfaces facing towards the stencil. The supporting body has radially diverging arms extending from a common center element coinciding with the center line of the stencil. The rollers are mounted at the extremities of the arms, and at least one of the rollers is movable from its operating position for releasing the end ring.

10 Claims, 14 Drawing Figures

ROTARY SCREEN SUPPORTING AND TENSIONING MEANS

BACKGROUND OF THE INVENTION

The present invention relates to a rotary printing machine, comprised of a cylindrical stencil which is connected to an end ring at each end. At least one frame is provided and carries a supporting body. Rollers are mounted on the supporting body. The rollers engage the end ring or rings on the circular surfaces which face towards the stencil.

The object of the present invention is to simplify the design of such devices, especially with stencils having a large circumference i.e. stencil circumferences that may be more than 1 m or even 3 m. At the same time the mounting and demounting of the stencil may be done in a fast and simple way.

According to the invention the supporting body has radially diverging arms extending from a common center element. The rollers are mounted at the extremities of the arms and at least one of the rollers is movable from its operating position in order to release the end ring.

SUMMARY OF THE INVENTION

If the movable roller is brought from its operating position into its release-position, for instance by swivelling it or by temporary demounting of this roller, the stencil may be brought into its working position in this the working position unmovable rollers engage the end rings. Subsequently, the stencil may be connected to the supporting body by bringing the movable roller back into its working position in which this roller, too, will engage the end ring.

The ease of mounting or demounting of the stencil largely depends on the supporting frame used. This depends on whether the supporting frame used is provided with a tensioning spar that extends axially through the stencil to form part of the supporting frame.

If the end portions of such a tensioning bar are fastened in vertical supports fixed to the machine frame, and if these supports are capable to withstand the forces acting transverse to the axis of the stencil and on the stencil itself then the length of the stencil may be changed without any difficulty. However, exchanging the stencil requires the removal of the stencil together with its tensioning spar and the supporting body from the machine.

When, the stencils used are of equal lengths it is preferred to fix the supporting bodies directly to holders. The holders are arranged laterally on the machine frame and are connected to the center element of the supporting body.

In this case a tensioning spar only serves to align the stencil and not to receive transverse forces acting on the stencil. Special care has to be taken to design the fixation of the center elements of the supporting body such that it is easy to disassemble. The stencil should then be easily removed from the supporting frame together with the supporting bodies mounted on each side of the stencil. Most of the preparation of the stencil for mounting may be done apart from the printing table, so that the periods of standstill of the machine may be kept low.

A modification in which the length of the screen is adjustable is needed when the tensioning spar is not part of the supporting frame. This modification provides two supporting spars that extend transversally to the longitudinal direction of the machine, each spar bearing to arms of the supporting bodies. Upon changing the stencil the tensioning spar if provided is removed from the stencil, and the removable roller is brought into its release position. The stencil may now be lifted out or inserted, that the supporting bodies remain on the supporting spars.

If the drive of the rotary stencil is effected by a gear engaging in the end ring of the stencil and if the supporting body is arranged outside the printing table, it is possible to provide fastening points for the rollers at different distances from the center. The same supporting body may then be used for mounting stencils with different diameters. This may be done by fixing the rollers on the arms nearer to the center when stencils of smaller diameters are used. The ends of the arms then simply extend laterally from the boundary edge of the printing table.

BRIEF DESCRIPTION OF THE DRAWINGS

Further details of the invention will be explained in the following text by means of the drawings, in which:

FIG. 14 is a tensioning mechanims for the device according to FIG. 13.

DESCRIPTION OF THE PREFERRED EMBODIMENTS

Figure 1:
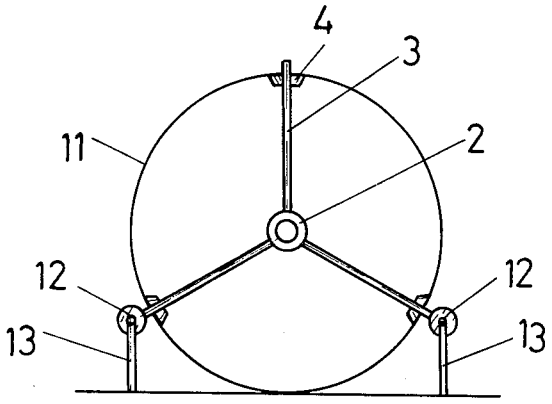
FIGS. 1—3 are a diagrammatic front view, a diagrammatic side view and a diagrammatic plan view of a first embodiment.
Figure 2:
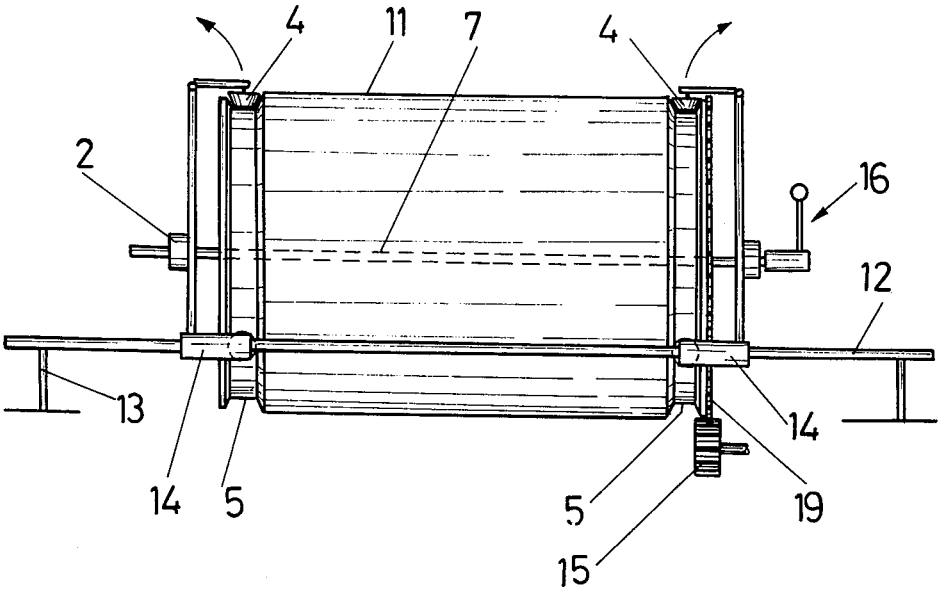
Figure 3:
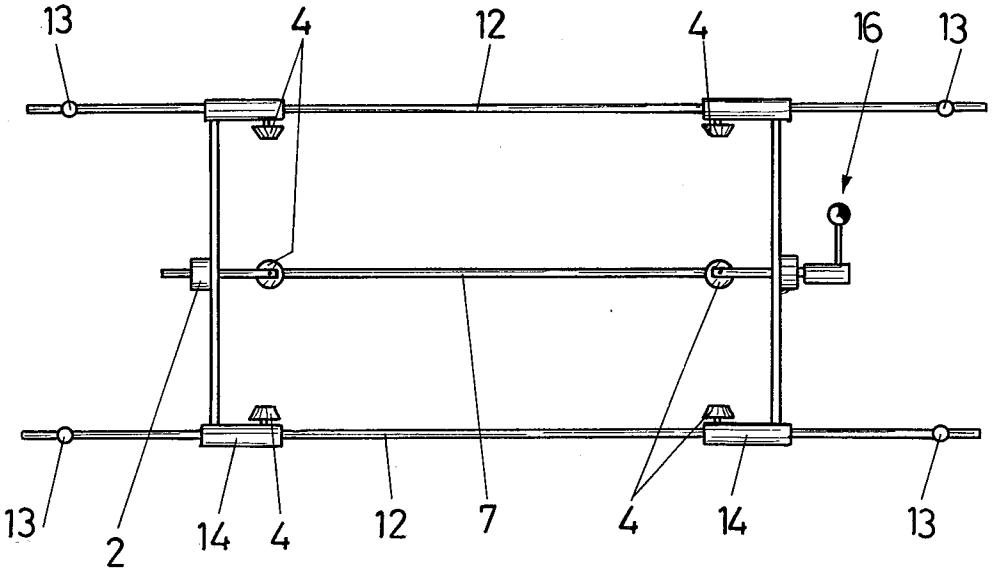
Figure 4:
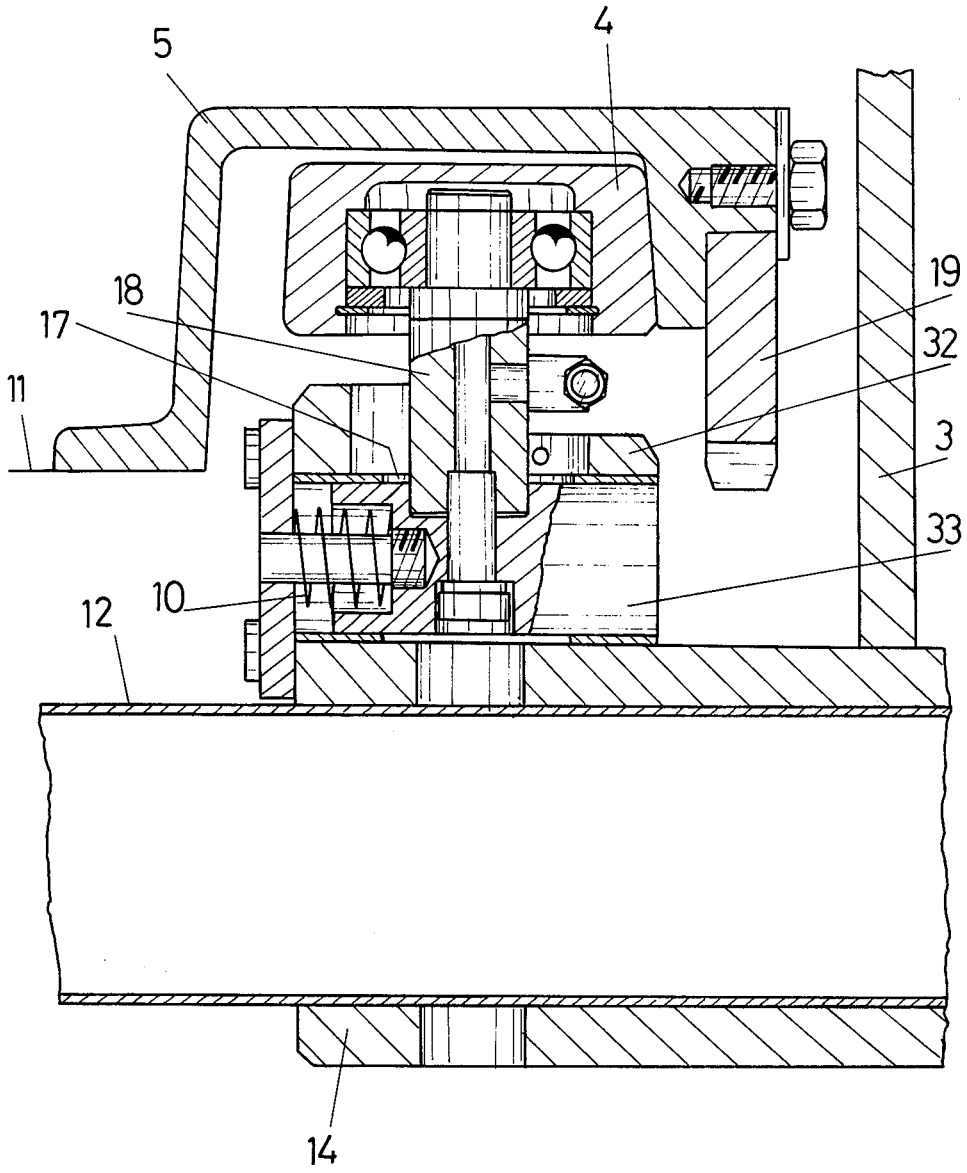
FIG. 4 is a section of a roller.

In the represented rotary printing machine a supporting frame extending over the width of the printing table is provided. The supporting frame essentially consists of two spars 12, supported by feet 13. The assembly of the two spars 12 into a rigid frame and at the same time the mounting of the stencil 11 is effected by two supporting bodies. According to the present invention this is formed by a center element 2 having the form of a sleeve and by arms 3 radially extending therefrom and bearing rollers 4.

In the embodiment according to FIGS. 1–4, the releasable fixation between the supporting frame and the supporting body is obtained by sleeves 14 being slid onto the spars 12 and each joined to a lower arm 3. During operation of the device, rollers 4 engage into the end rings 5 of the stencil 11, by which the stencil obtains a reliable guide. The drive of the stencil 11 is effected by a gear wheel 15 engaged with at least one of the end disks 5 or with the gear rings 19 being mounted onto the end ring.

Figure 12:
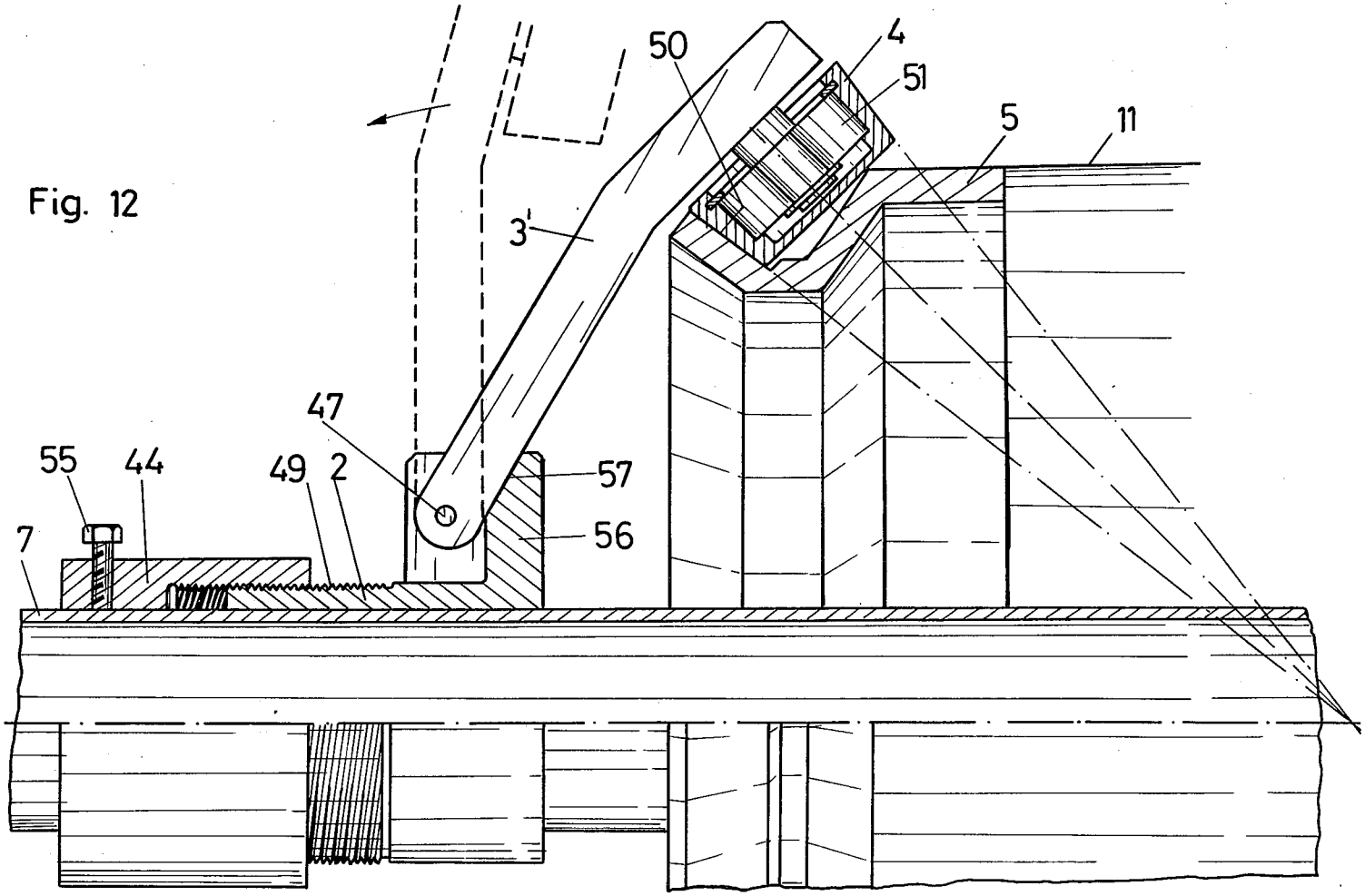

If the stencil 11 is changed while the supporting bodies on both sides remain fastened to the spars 12, not only do the two upper rollers 4 have to be swivelled back as shown by arrows in FIG. 12 but also the tensioning spar 7 has to be removed from the stencil. This is possible without any difficulties in the represented device because the tensioning spar 7 does not form part of the frame supporting the supporting bodies. The tensioning spar 7 therefore may be removed at any time from the stencil 11 after releasing the diagrammatically shown tensioning device 16, without affecting the connection of the clamping device with the machine.

According to an advantageous embodiment of the invention the rollers 4 may be spring-mounted. This can be seen in FIG. 4. The roller 4 is rotatably mounted on a pin 18. This pin is seated in an extension 32 of a sliding piece 33 on sleeve 14. The sliding piece 33 is pressurized by cup springs 10, so that the pin 18 in slit 17 is pressed as far as possible against the outer edge of the end ring 5.

Figure 5:
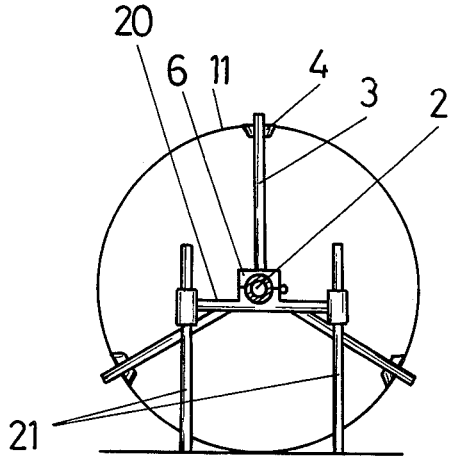
FIGS. 5–6 are a front view and a side view of a further embodiment.
Figure 6:
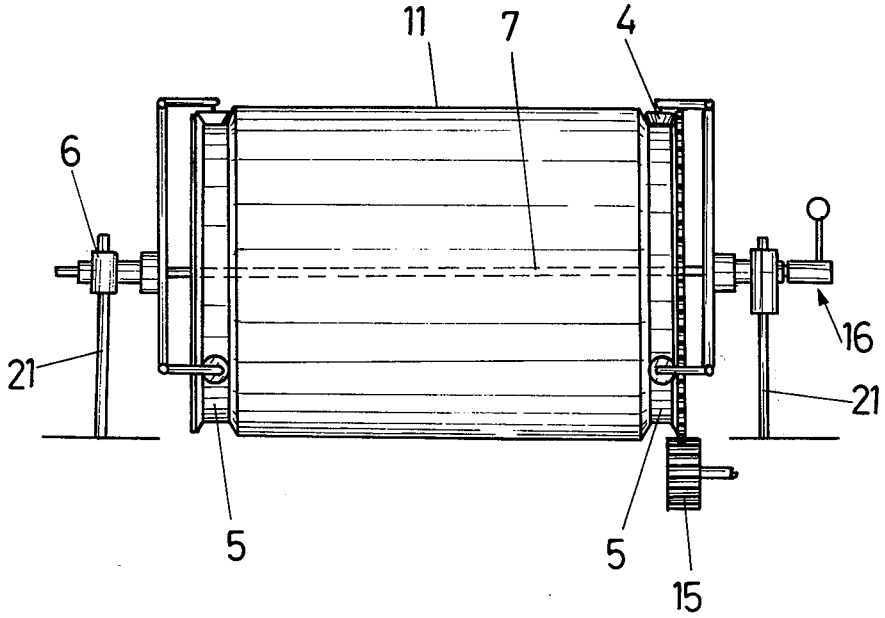

The embodiment diagrammatically shown in FIGS. 5 and 6 differes from the described example, especially by the lack of the spars extending over the width of the apparatus. They are replaced by vertical supports 21, which are connected to each other by a crossbar 20. The holder of the center element 2 has again the form of a sleeve formed by a swivel bearing with a pivotable clamping piece 6.

Figure 7A:
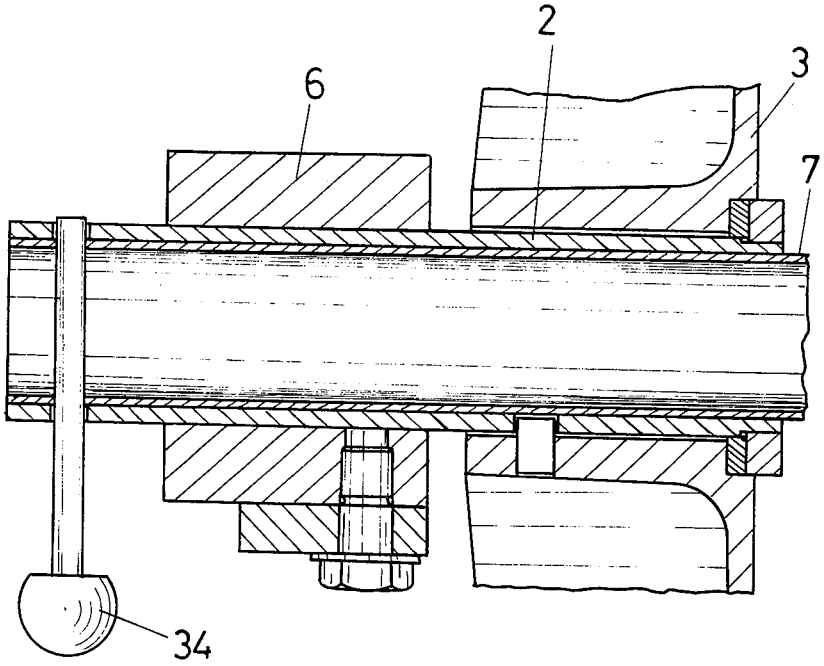
FIGS. 7–10 are sections of details of the second embodiment.
Figure 7B:
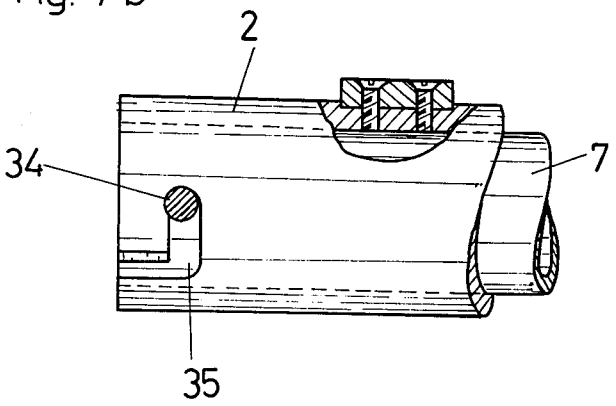

FIG. 7 shows in detail the bayonet joint provided for the left-sided fixation of the tensioning spar 7 to the center element 2. The bayonet-joint simply consists of a lever arm 34 fixed to the tensioning spar 7. The lever arm 34 engages a slit 35 in the center element 2.

Figure 8:
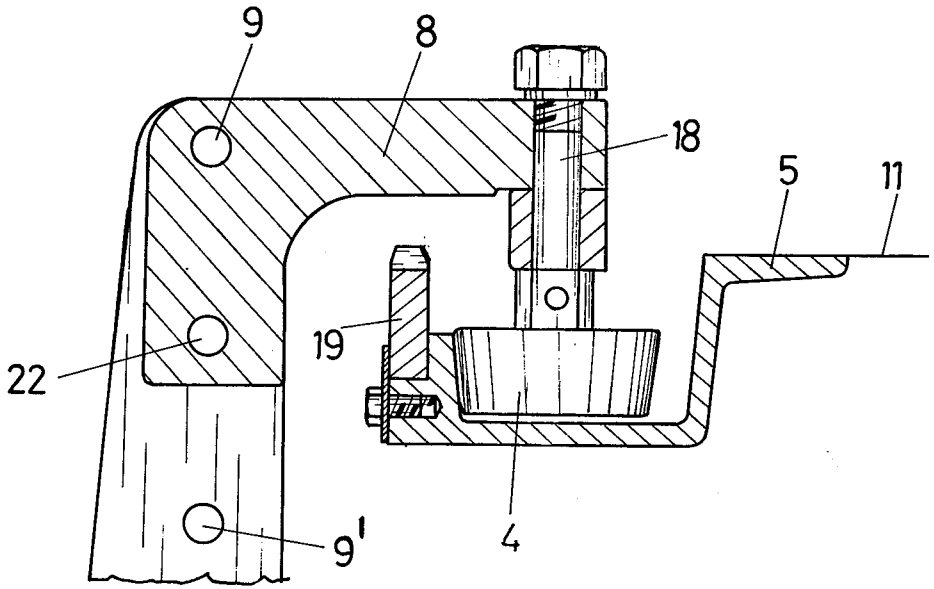

FIG. 8 is a representation in detail of the pivotable roller 4 of FIG. 6 on the upper left-hand side. The roller is supported via pin 18 on a bent lever 8 which is fixed by means of pin 22 and screw 9 to arm 3. By unscrewing screw 9 the bent lever 8 can be pivoted on pin 22, by which the stencil is released. When using a screen having a smaller diameter, the bent lever 8 on arm 3 can be displaced towards the center, so that screw 9 reaches position 9'.

Figure 9:
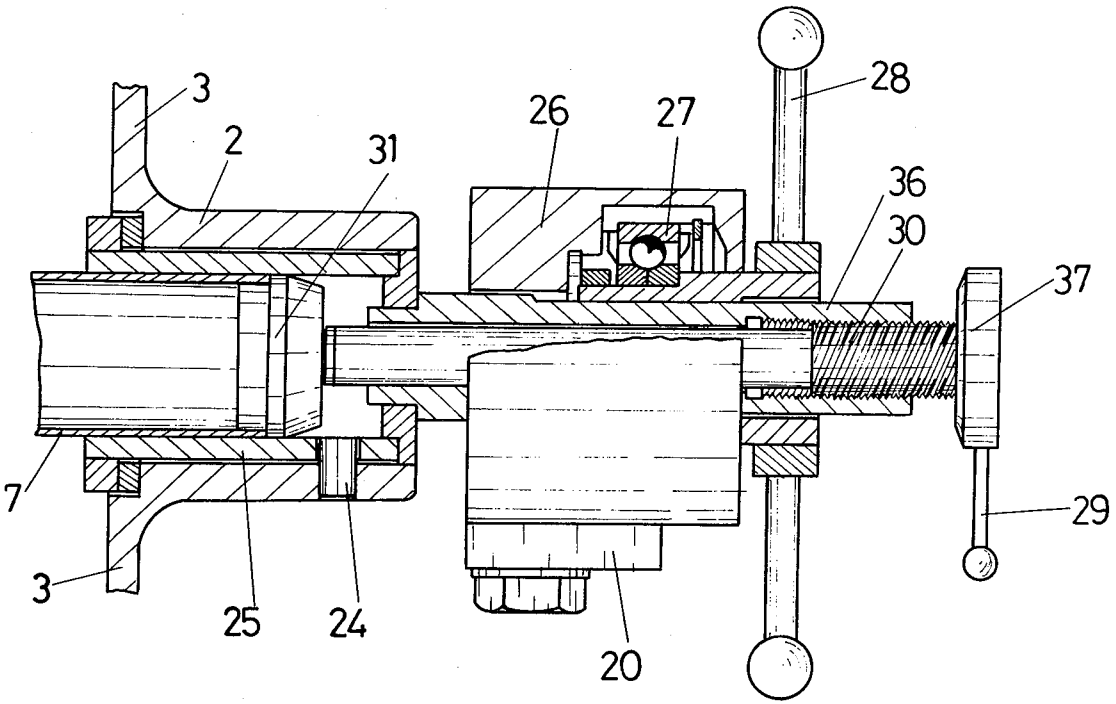

FIG. 9 shows the central part of the right-hand stencil holder of FIG. 6. The center element 2 is connected, as may be seen, on an axle journal 25, an elastic intermediate ring 23 being provided between both parts. A bolt 24 serves to prevent rotation. Axle journal 25 is supported via threaded sleeve 36 and bearing 27 in a housing 26. When handwheel 28 is rotated axle journal 25 will be displaced axially due to the action of threaded sleeve 36. If the stencil is to be tensioned lever 29 is rotated. This rotation is transmitted via a slipping clutch 37 to threaded bolt 30 which pushes end piece 31 lodged in tensioning spar 7.

Figure 10:
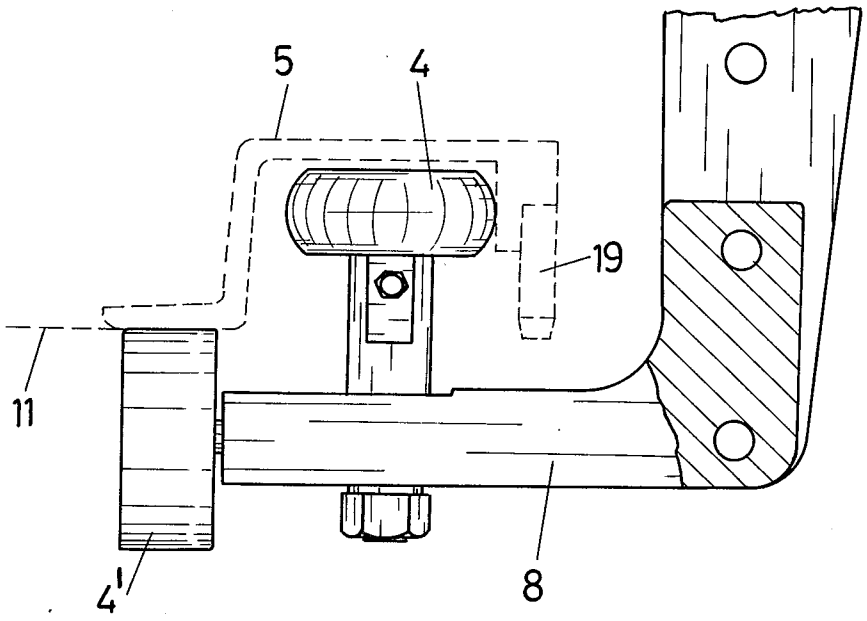

As may be seen in FIG. 10 cylindrical rollers 4' has an axis running parallel to the axis of the stencil. The axis of the stencil may provide, in addition to the rollers 4, serving tension to stencil 11, to ensure the radial guidance of stencil 11.

With this arrangement, the rollers 4 do not have to be responsible any more for the radial fixation of the stencil; they need not be tapered. As shown in FIG. 10 crowned rollers 4 engage a surface of the end ring 5. The crowned roller extend normally to the axis of the stencil and may be combined with different end portions without any adapting difficulties.

The following embodiments are characterized on one hand by the fact that the center element 2 is not fixed directly in a supporting frame arranged laterally to the frame of the machine. However, the supporting body is fixed in the tensioning spar 7 which is mounted in essentially the same manner as shown in FIG. 5. On the other hand in the embodiment according to FIGS. 12–14 each of the arms 3 carrying the adjustable roller 4, can be pivoted as a whole.

Figure 11:
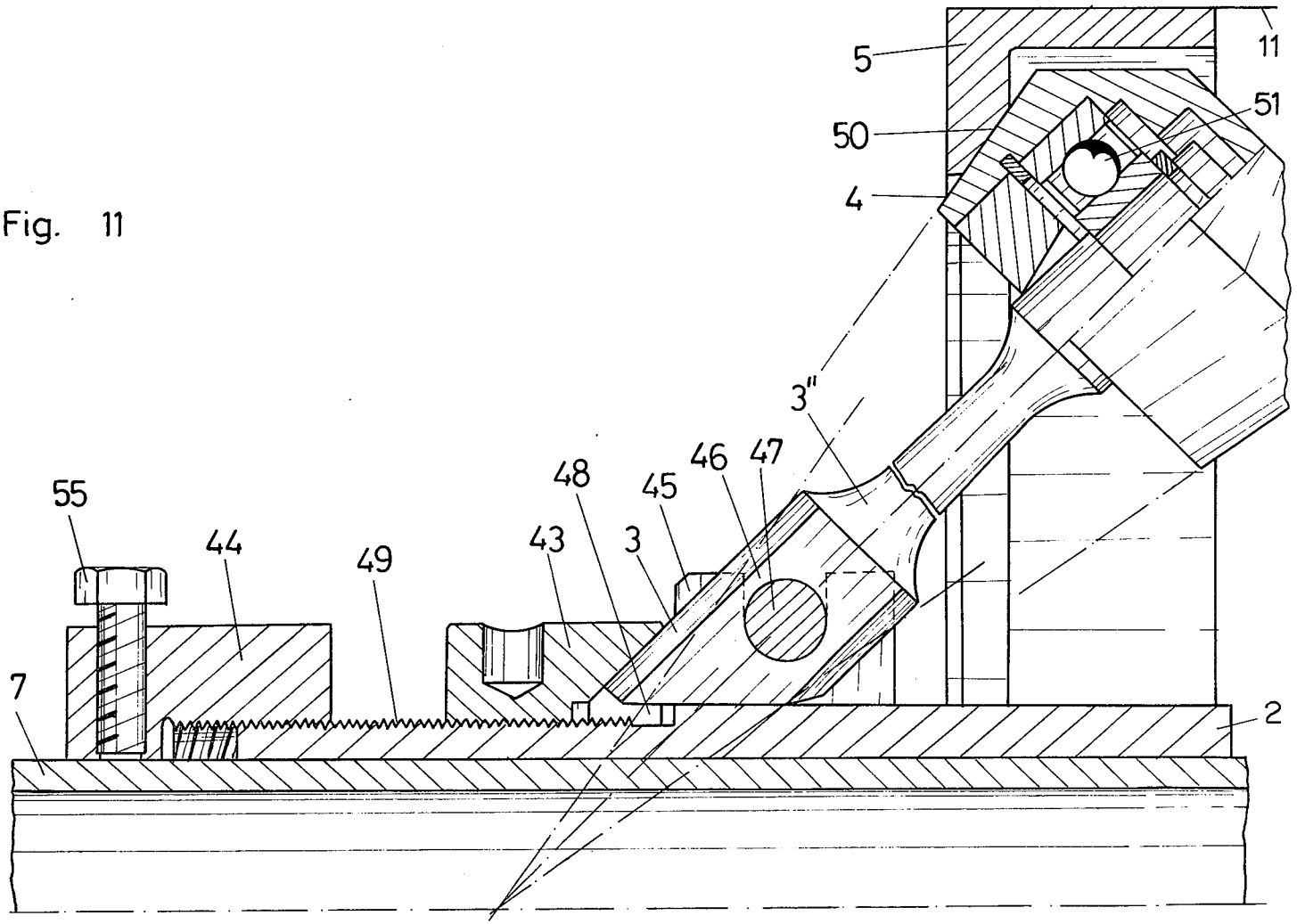
FIGS. 11–13 are sections of further three embodiments, the supporting body which is fastened onto a tensioning spar forming part of the supporting frame.

In the embodiment shown in FIG. 11 the tensioning spar 7 is mounted, at its end, in suitable holders and also serves for the dye supply. Center element 2 is glidably mounted on spar 7, and arms 3'' bearing each a roller 4 are pivotably connected thereto by means of swiveling bolts 47 housed in holders of center element 2.

Each of these holders for the swiveling bolt 47 is formed by axially arranged forked ears 45. In slits 46 of these holders, the swiveling bolt 47 firmly connected to the arm 3 may be inserted. The fixation of the pivotale arm 3 is effected by a locking piece 43. This locking piece is similarly formed as a round nut and may be pressed against the pivotable arm 3'' by means of the thread 49. Due to the inclination of the arm 3'' its base 48 thereby is pressed against the sleeve-formed center element 2. This is done so that the arm 3'' via the locking piece 43, the base 48 and the swivel bolt 47 is definitely fixed in its position. This is true, too, for the embodiment according to FIG. 13.

If the rotary stencil glued to the end rings 5 shall be exchanged, only the clamping screw 55 in the tensioning nut 44 and the locking piece 43 need be unscrewed. Thereby tensil force exerted on the stencil 11 is reduced and the rollers 4 loose their contact with the end ring 5. The arm 3'' in the embodiment according to FIGS. 11 and 13 may be swivelled into the interior of the stencil, and the arm 3'' in the embodiment according to FIG. 11 can be totally removed. Thereafter the stencil 11 may be drawn off over two other rigid arms not shown in the drawings. It is selfevident that more than three arms may be provided and several or even all arms may be pivotable. The mounting of the new stencil 11 is effected in such manner that the stencil along with the end rings 5 is slid on, whereafter the pivotable arm 3'' is lifted and fixed by tensioning the locking piece 43. The center element 2 is then pushed back until roller 4 contacts the end ring 5 and the clamping screw 55 is tightened. By screwing the center element 2 into the fixed tensioning nut 44 the desired tension of the stencil 11 is obtained.

In the embodiment according to FIG. 12, the pivotable arm 3' abuts on a collar 56 having a tapered stop face 57. The roller 4 mounted on the arm engages the end ring 5 from the outside different from the embodiments according to FIGS. 11 and 13. This embodiment permits arm 3' to pivot as indicated in dotted lines after the clamping screw 55 has been unscrewed.

In order to prevent a gliding movement of rollers 4, which are held directly by ball bearings 51 or via a pin by the arms on the end ring 5, the face 50 of the roller 4 abutting the end ring 5 is formed as part of a conical surface. The apex of the cone coincides with the point of intersection of the longitudinal axis of the rotary stencil 11 and the axle of rotation of the roller 4.

The swivel bolts 47, shown in the embodiments, are arranged transverse to the longitudinal axis of the rotary stencil 11 and transverse to the axis of arm 3', 3'' other devices enabling a change of the position of at least on roller 4 relatively to the tensioning spar 7 may be provided. One or more arms may be pivotably arranged around the longitudinal axis of the rotary stencil or an axis running parallel to it. In the latter case all arms may be pivotably arranged. Rollers 4 generally suffice for the centering of the end rings 5 and thus the rotary stencil 11. If, however, stencils are used having a relatively large diameter and working at relatively high printing velocities, a slight shift of the stencil 11 and thus misprintings may occur. In order to prevent this, it may be provided that an edge 52 (FIG. 13) of roller 4 cooperates with a shoulder of the end ring 5 and thus a certain support of the end ring 5 is attained.

Figure 13:
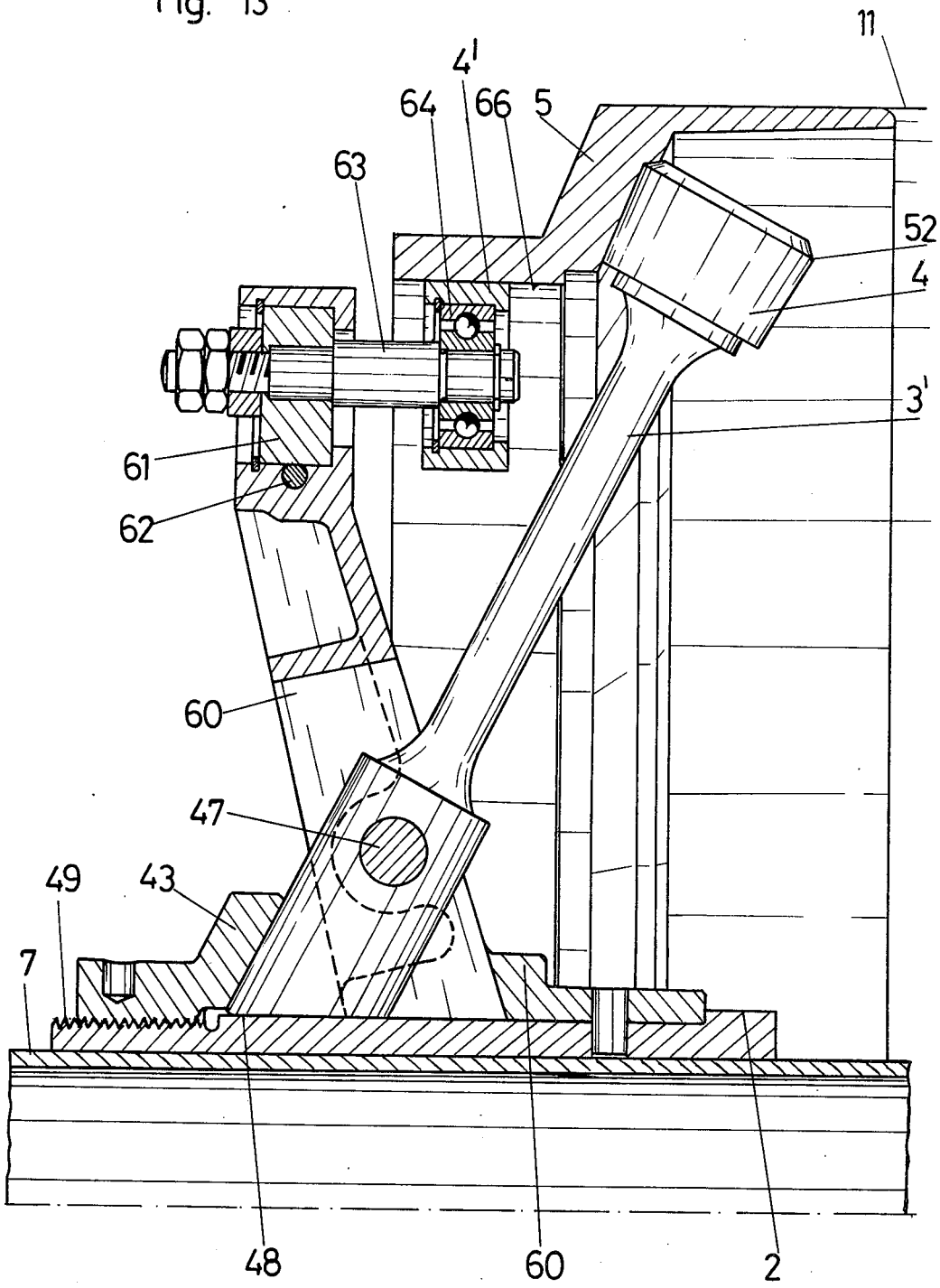

A support of the end ring 5 with which a shifting of the stencil 11 during its acceleration may positively be prevented, may be obtained, as shown in FIG. 13, by the arrangement of additional supporting arms 60. To enable an exchange of the rotary stencil it is advantageous to keep the outermost end portion of the supporting arm 60 at a distance from the longitudinal axis of the stencil 11. This distance should be smaller than the smallest diameter of the stencil 11 or of the end ring 5. In order to obtain that support roller 4', which is mounted via a bearing 64 by a bolt 63, should abut the cylindrical surface 66 of the end ring 5. It is sufficient to lodge the bolt 63 in an eccentric disk 61, which is pivotally mounted in the head of the support arm 60. In order to fix the eccentric disk 61, pin 62, a wedge-shaped ascendingly flat screw, is arranged transverse to the axis of rotation of the eccentric disk 61, pressing the eccentric disk upward and fixing it.

In the represented embodiment the supporting arm 60 is mounted on the center element 2 and carries in its upper fork-like portion a swivelling bolt 47 for the pivotable clamping arm 3'.

What I claim is:

1. A rotary printing machine, comprising a cylindrical stencil; an end ring connected at each end to said cylindrical stencil, a supporting frame; a supporting body carried by said frame at each end of said stencil and each supporting body comprising rollers engaging a respective said end ring to guide and tension the stencil; each said supporting body further comprising a center element and radially diverging arms extending from said center element, the rollers of each supporting body being mounted at the extremities of said arms, at least one of said rollers of each supporting body being movable from its operating position for releasing said end rings.

2. A rotary printing machine as claimed in claim 1, including pivotable clamping means, said center element being mounted on said supporting frame by said pivotable clamping means.

3. A rotary printing machine as claimed in claim 1 including a tensioning spar, said center element comprises a sleeve for receiving said tensioning spar.

4. A rotary printing machine as claimed in claim 3, wherein said tensioning spar is removable from the stencil.

5. A rotary printing machine as claimed in claim 1, including two sleeves mounted on two of said arms at each end of said stencil and said supporting frame comprising spars fastened to said arms by said sleeves, said spars extending parallel to the stencil.

6. A rotary printing machine as claimed in claim 1 including a screw and bent lever carrying at least one of said rollers, said screw locking said lever in position and said lever being pivotable after removal of said screw.

7. A rotary printing machine as claimed in claim 1 including spring means biasing each of said rollers, said rollers being slidably mounted toward the stencil against the action of said spring means.

8. A rotary printing machine as claimed in claim 1, wherein said stencil has a rotational axis, one of said arms having a pivot axis running transverse to said rotational axis of the stencil.

9. A rotary printing machine, comprising a cylindrical stencil; end ring connected at each end to said cylindrical stencil, a supporting frame; a supporting body carried by said frame at each end of said stencil and each supporting body comprising rollers engaging a respective said end ring to guide and tension the stencil; each further said supporting body comprising a center element and radially diverging arms extending from said center element, the rollers of each supporting body being mounted at the extremities of said arms, at least one of said rollers of each supporting body being movable from its operating position for releasing said end rings, a tensioning spar, each said center element comprising a sleeve for receiving said tensioning spar, said stencil having a rotational axis, one of said arms having a pivot axis running transverse to said rotational axis of the stencil, a sleeve-formed locking piece slidable on said center element, another of said arms being a double lever with a part extending towards the axis of the stencil and abutting on said sleeve-formed locking piece.

10. A rotary printing machine, comprising a cylindrical stencil; end ring connected at each end to said cylindrical stencil, a supporting frame; a supporting body carried by said frame at each end of said stencil and each supporting body comprising rollers engaging a respective said end ring to guide and tension the stencil; each said supporting body having a center element and radially diverging arms extending from said center element, the rollers of each supporting body being mounted at the extremities of said arms, at least one of said rollers of each supporting body being movable from its operating position for releasing said end rings, a tensioning spar, each said center element comprising a sleeve for receiving said tensioning spar, said stencil having a rotational axis, one of said arms having a pivot axis running transverse to said axis of the stencil, each roller having a face abutting each said end ring and being part of a conical surface whose apex coincides with the point of intersection of the axis of the stencil and the axis of rotation of said roller.

* * * * *